US010767824B2

(12) United States Patent
Smith et al.

(10) Patent No.: US 10,767,824 B2
(45) Date of Patent: Sep. 8, 2020

(54) LED NIGHT-LIGHT WITH COLOR FILTER

(71) Applicant: Mary Elle Fashions, Inc., St. Louis, MO (US)

(72) Inventors: Matthew S. Smith, St. Charles, MO (US); James J. Riley, St. Louis, MO (US); Kenneth A. Howard, Creve Coeur, MO (US); Gavin Perry, Webster Groves, MO (US)

(73) Assignee: Mary Elle Fashions, Inc., St. Louis, MO (US)

( * ) Notice: Subject to any disclaimer, the term of this patent is extended or adjusted under 35 U.S.C. 154(b) by 0 days.

(21) Appl. No.: 16/113,990

(22) Filed: Aug. 27, 2018

(65) Prior Publication Data

US 2020/0063928 A1 Feb. 27, 2020

(51) Int. Cl.

| | |
|---|---|
| ***F21S 8/00*** | (2006.01) |
| ***F21V 33/00*** | (2006.01) |
| ***F21V 23/04*** | (2006.01) |
| ***F21S 10/00*** | (2006.01) |
| ***H01R 24/68*** | (2011.01) |
| *H01R 103/00* | (2006.01) |
| *F21W 121/00* | (2006.01) |
| *F21Y 115/10* | (2016.01) |

(52) U.S. Cl.

CPC ..... *F21S 8/035* (2013.01); *F21S 10/005* (2013.01); *F21V 23/04* (2013.01); *F21V 33/0004* (2013.01); *H01R 24/68* (2013.01); *F21W 2121/00* (2013.01); *F21Y 2115/10* (2016.08); *H01R 2103/00* (2013.01)

(58) Field of Classification Search

CPC ..... F21S 8/035; F21S 10/005; H01R 24/68; H01R 2103/00; F21V 23/04; F21V 33/0004; F21Y 2115/10; F21W 2121/00

USPC ..... 362/641–644, 647, 650, 657–659, 646, 362/653, 249.02

See application file for complete search history.

(56) References Cited

U.S. PATENT DOCUMENTS

| | | | | |
|---|---|---|---|---|
| D348,111 | S | 6/1994 | Yuen | |
| D431,660 | S | 10/2000 | Yuen | |
| D471,654 | S | 3/2003 | Schenck | |
| 7,056,006 | B2 * | 6/2006 | Smith | F21S 8/035 362/641 |
| 7,712,915 | B2 | 5/2010 | Liu | |
| 8,721,160 | B2 * | 5/2014 | Chien | F21S 9/02 362/641 |
| D721,449 | S | 1/2015 | Chen | |
| D751,228 | S | 3/2016 | Howard et al. | |
| D751,229 | S | 3/2016 | Howard et al. | |
| D790,091 | S | 6/2017 | Howard et al. | |
| D796,707 | S | 9/2017 | Howard et al. | |

(Continued)

*Primary Examiner* — Tracie Y Green
(74) *Attorney, Agent, or Firm* — Stinson LLP

(57) ABSTRACT

An LED night-light includes a housing and first and second prongs extending out of the housing. A light-emitting diode is mounted to the housing and is configured to emit a first color of light. Circuitry is electrically connected to the light-emitting diode. The circuitry is configured for energizing the light-emitting diode when the first and second prongs are inserted into an electrical outlet connected to a power source. A color filter is mounted on the housing. The color filter is configured to filter the first color of light emitted from the light emitting diode to produce at least a second color of light different from the first color of light.

13 Claims, 15 Drawing Sheets

(56) References Cited

U.S. PATENT DOCUMENTS

| | | | | |
|---|---|---|---|---|
| D808,045 | S | 1/2018 | Howard et al. | |
| 10,041,639 | B1 * | 8/2018 | Thompson | F21S 8/035 |
| 2006/0171141 | A1 * | 8/2006 | Tsai | F21S 8/035<br>362/95 |
| 2009/0284960 | A1 * | 11/2009 | Chien | F21S 4/28<br>362/157 |
| 2010/0290254 | A1 | 11/2010 | Howard et al. | |
| 2011/0110119 | A1 | 5/2011 | Hsiao | |
| 2013/0044518 | A1 | 2/2013 | Yang | |
| 2014/0185325 | A1 * | 7/2014 | Howard | F21S 8/035<br>362/641 |
| 2014/0226336 | A1 * | 8/2014 | Chi | F21K 9/65<br>262/280 |

* cited by examiner

LED NIGHT-LIGHT WITH COLOR FILTER

BACKGROUND

The present disclosure generally relates to an LED (light-emitting diode) night-light, and more specifically to an LED night-light configured to emit different colors of light.

A typical night-light includes an incandescent bulb or LED electrically connected to circuitry and prongs of the night-light so that when the night-light is connected to a power source, the bulb or LED can emit light to illuminate the surrounding environment. The bulb/LED may be configured to emit light within a single wavelength such that the night-light emits light of a single color.

SUMMARY

In one aspect, an LED night-light generally comprises a housing and first and second prongs extending out of the housing. A light-emitting diode is mounted to the housing and is configured to emit a first color of light. Circuitry is electrically connected to the light-emitting diode. The circuitry is configured for energizing the light-emitting diode when the first and second prongs are inserted into an electrical outlet connected to a power source. A color filter is mounted on the housing. The color filter is configured to filter the first color of light emitted from the light emitting diode to produce at least a second color of light different from the first color of light.

In another aspect, a method of producing multiple colors of light from an LED night-light is disclosed. The night-light comprises a housing, a light-emitting diode mounted to the housing and configured to emit a first color of light, and circuitry electrically connected to the light-emitting diode. The circuitry is configured for energizing the light-emitting diode when first and second prongs of the night-light are inserted into an electrical outlet connected to a power source. The method generally comprises rotating a color wheel mounted on the housing to selectively place color filter sections of a color filter of the color wheel in registration with the light-emitting diode to filter the first color of light emitted from the light emitting diode to produce at least a second color of light different from the first color of light.

Other features will be in part apparent and in part pointed out hereinafter.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Corresponding reference characters indicate corresponding parts throughout the drawings.

DESCRIPTION OF THE PREFERRED EMBODIMENTS

Figure 6:
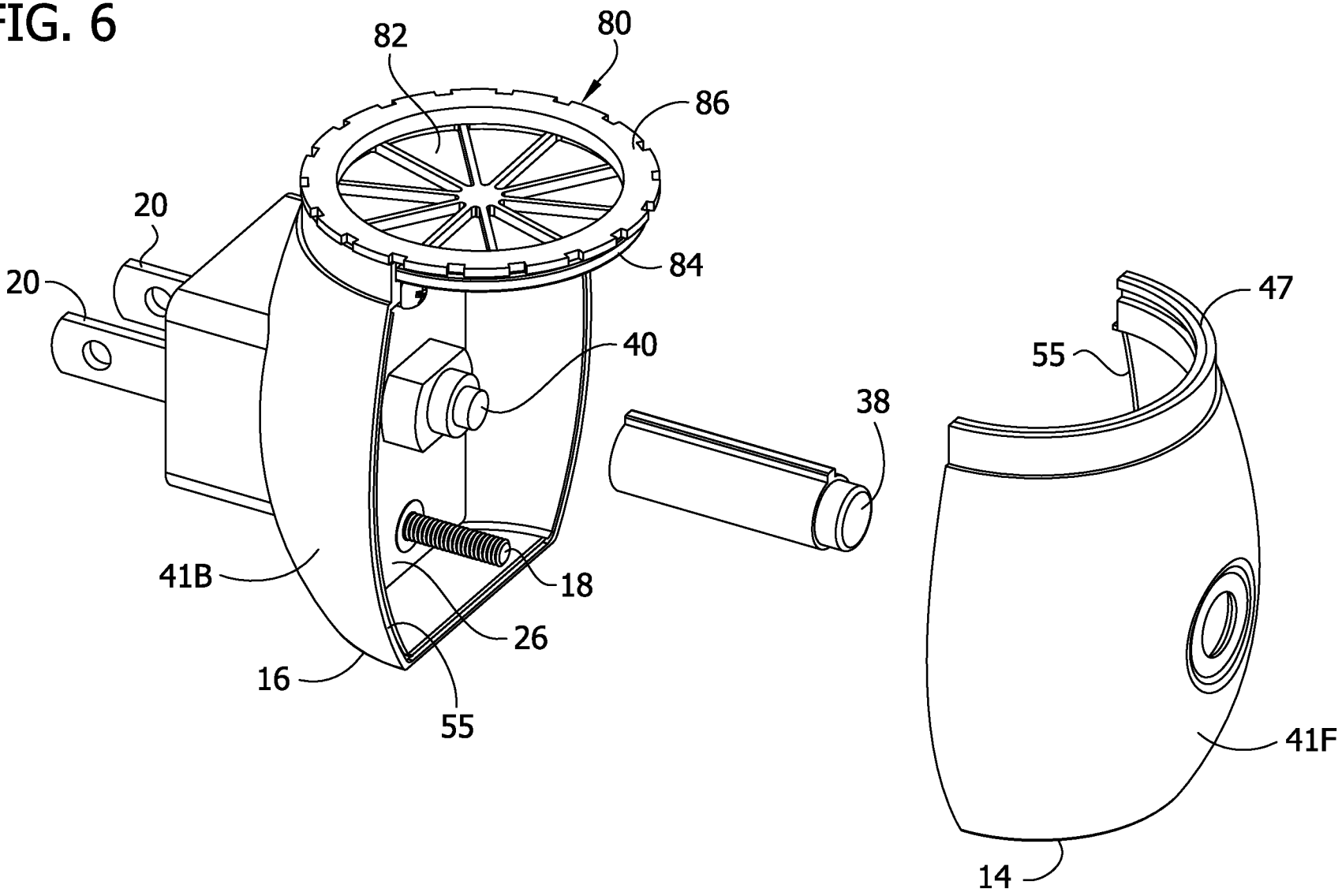
FIG. 6 is an exploded view of the LED night-light of FIG. 3.
Figure 7:
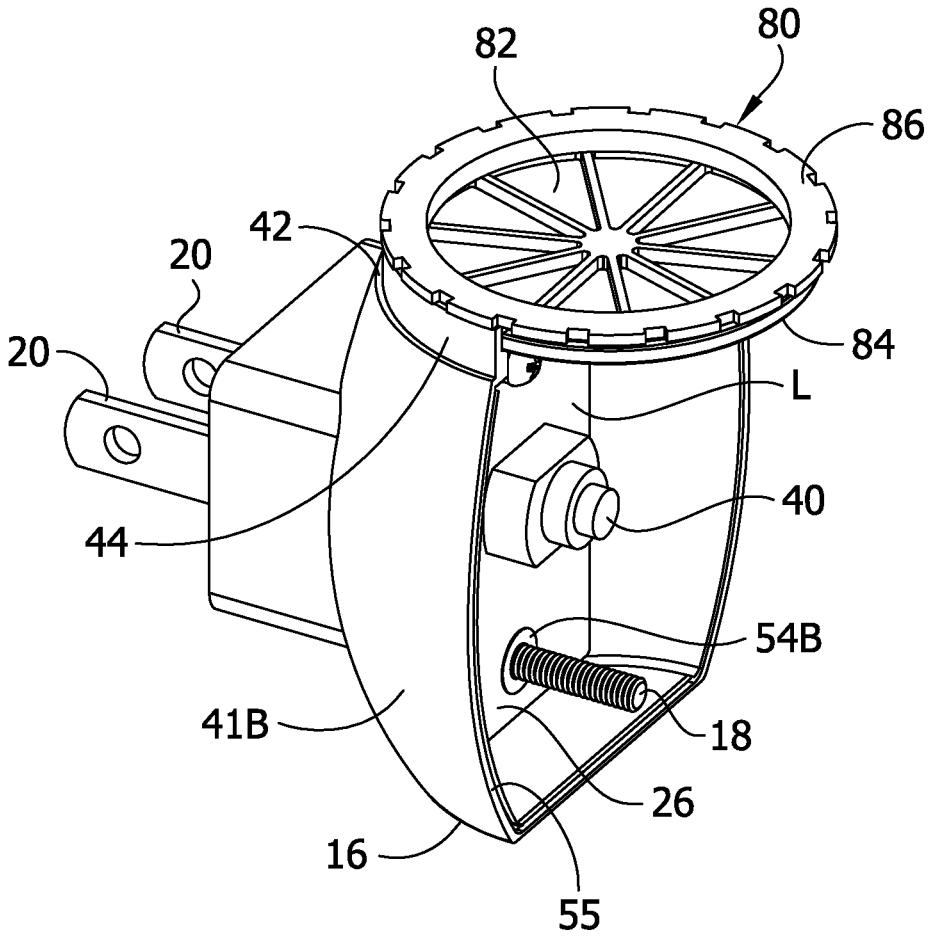
FIG. 7 is a perspective view of a back panel of the LED night-light showing a color wheel received within a groove in the back panel.
Figure 8:
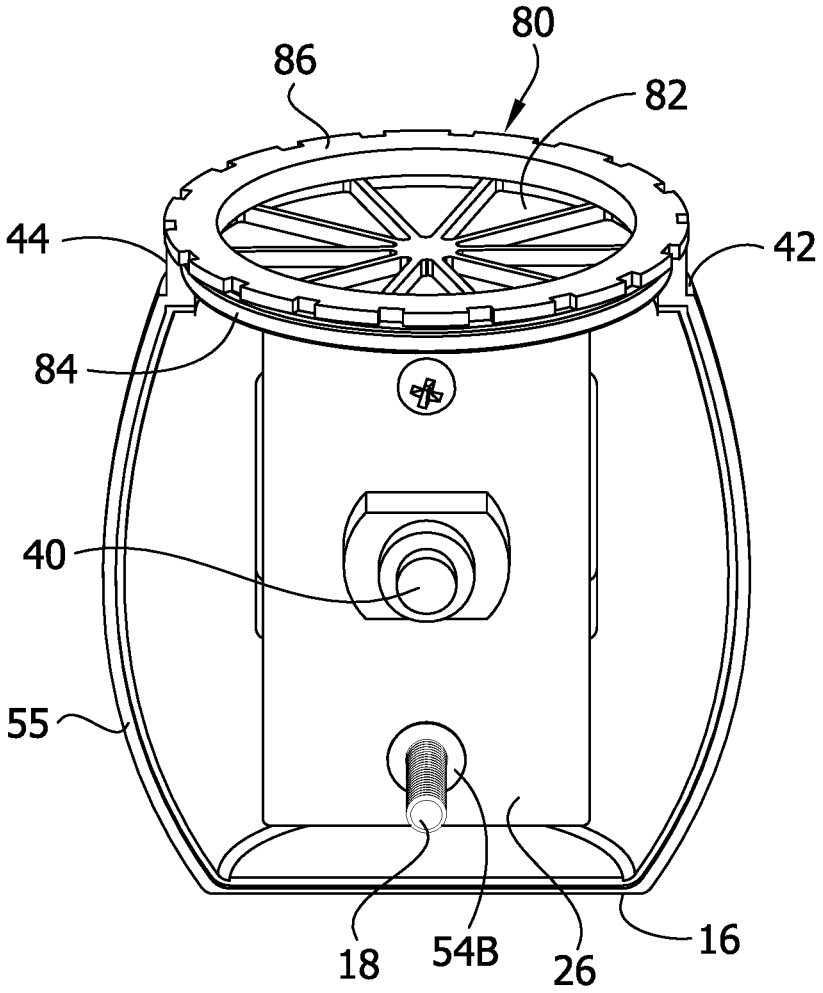
FIG. 8 is a front view of the back panel in FIG. 7.
Figure 9:
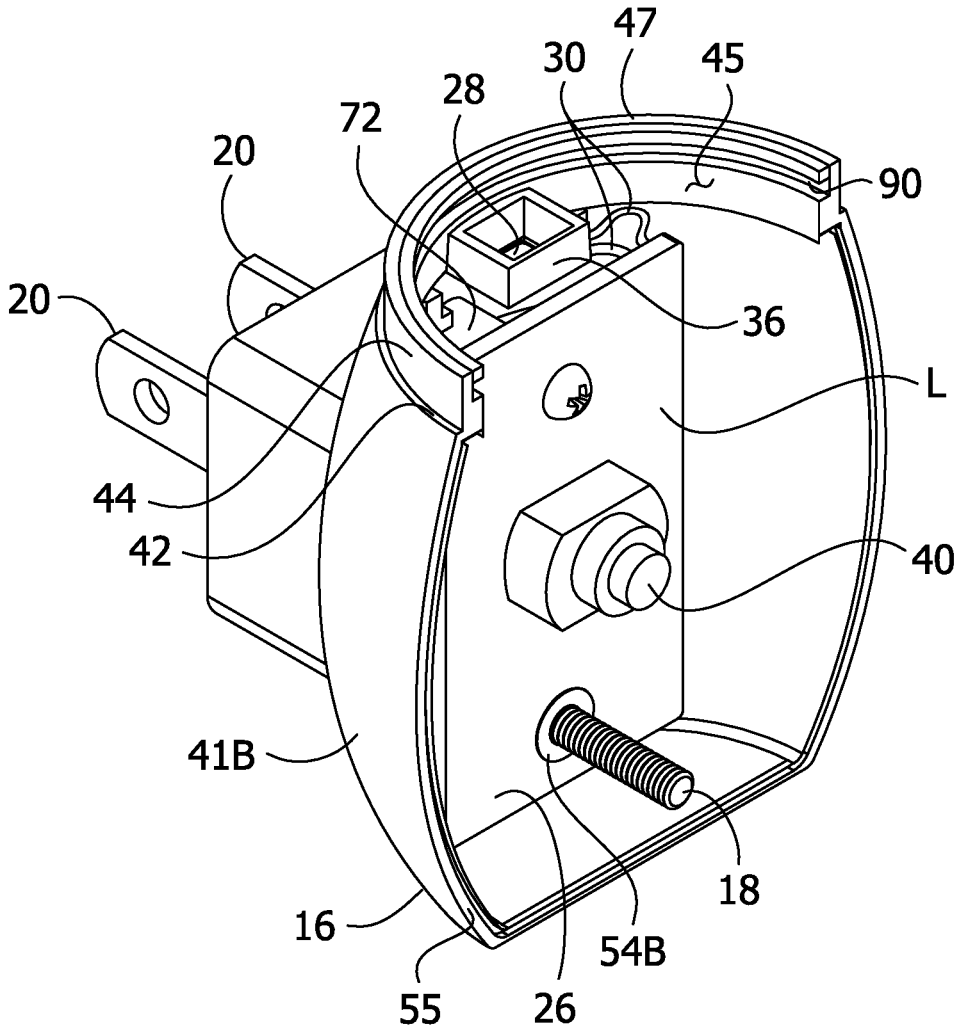
FIG. 9 is a perspective view of the back panel of the LED night-light with the color wheel removed.
Figure 10:
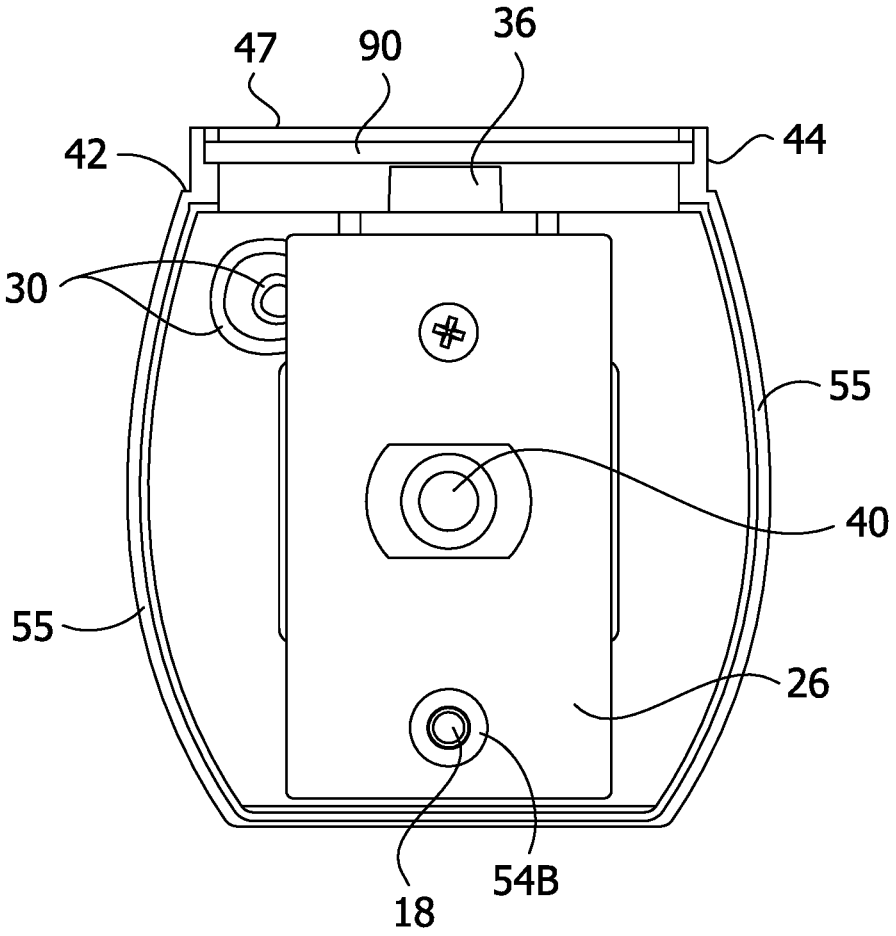
FIG. 10 is a front view of the back panel in FIG. 9.
Figure 11:
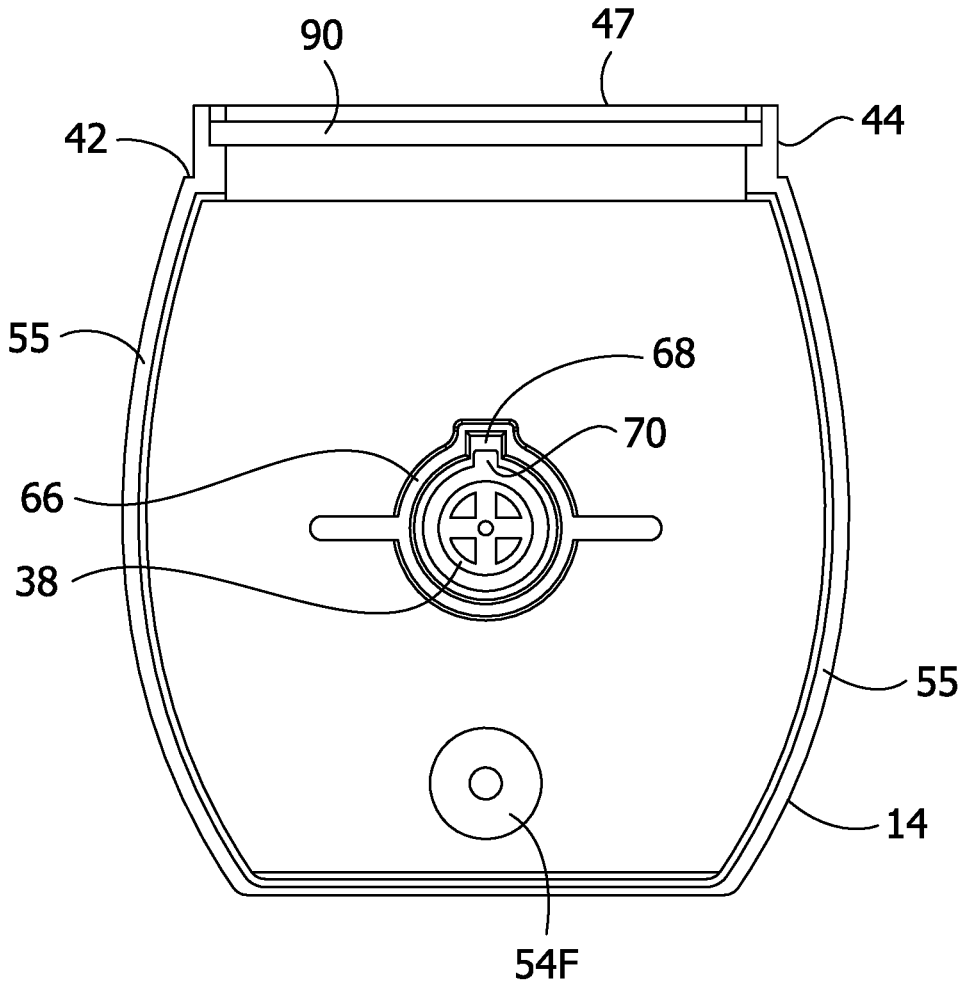
FIG. 11 is a back view of a front panel of a housing of the LED night-light.
Figure 12:
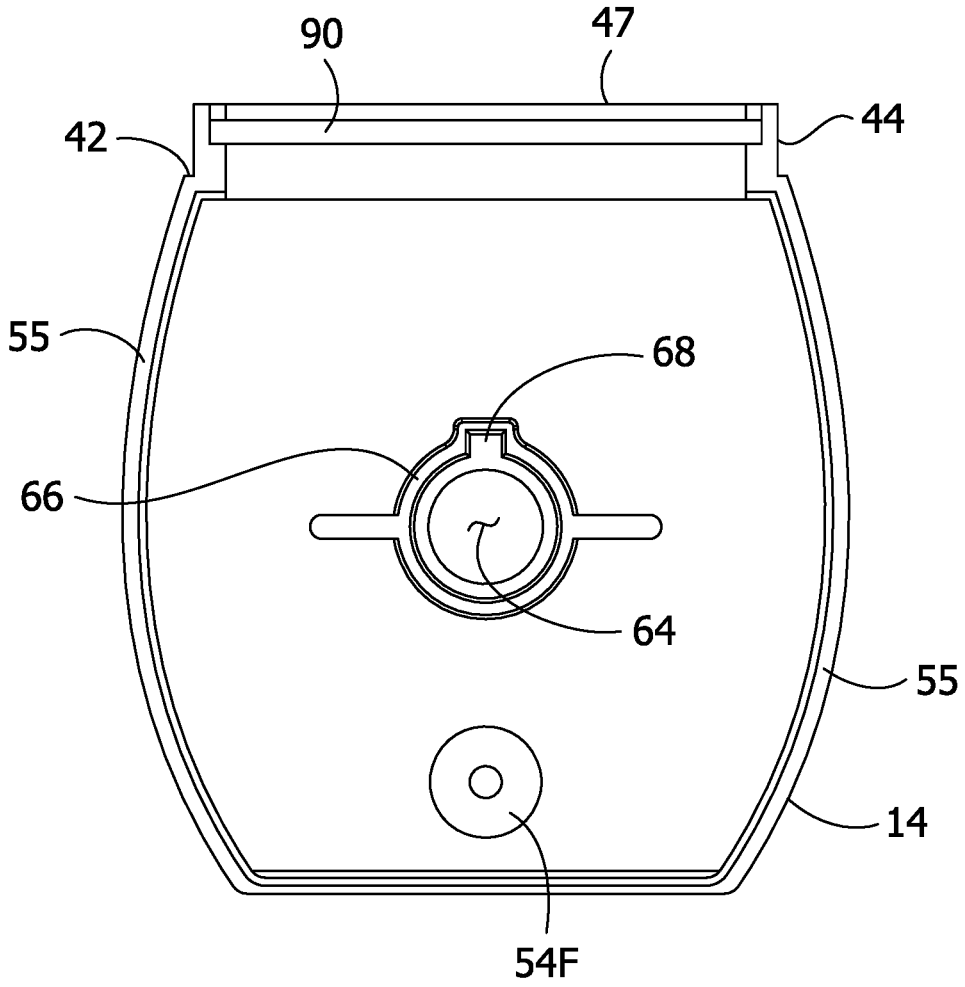
FIG. 12 is a back view of the front panel of the housing of the LED night-light with a button removed.
Figure 13:
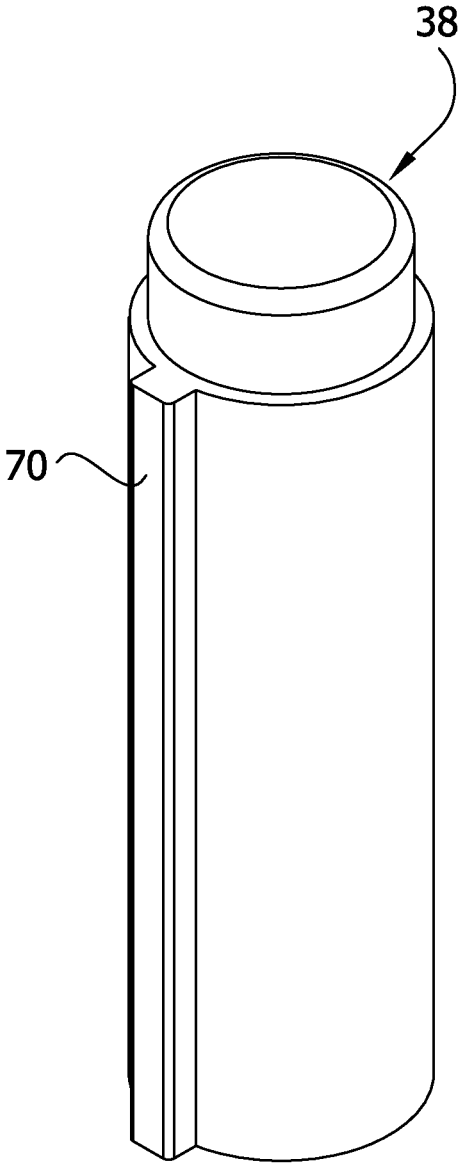
FIG. 13 is a perspective of the button.
Figure 14:
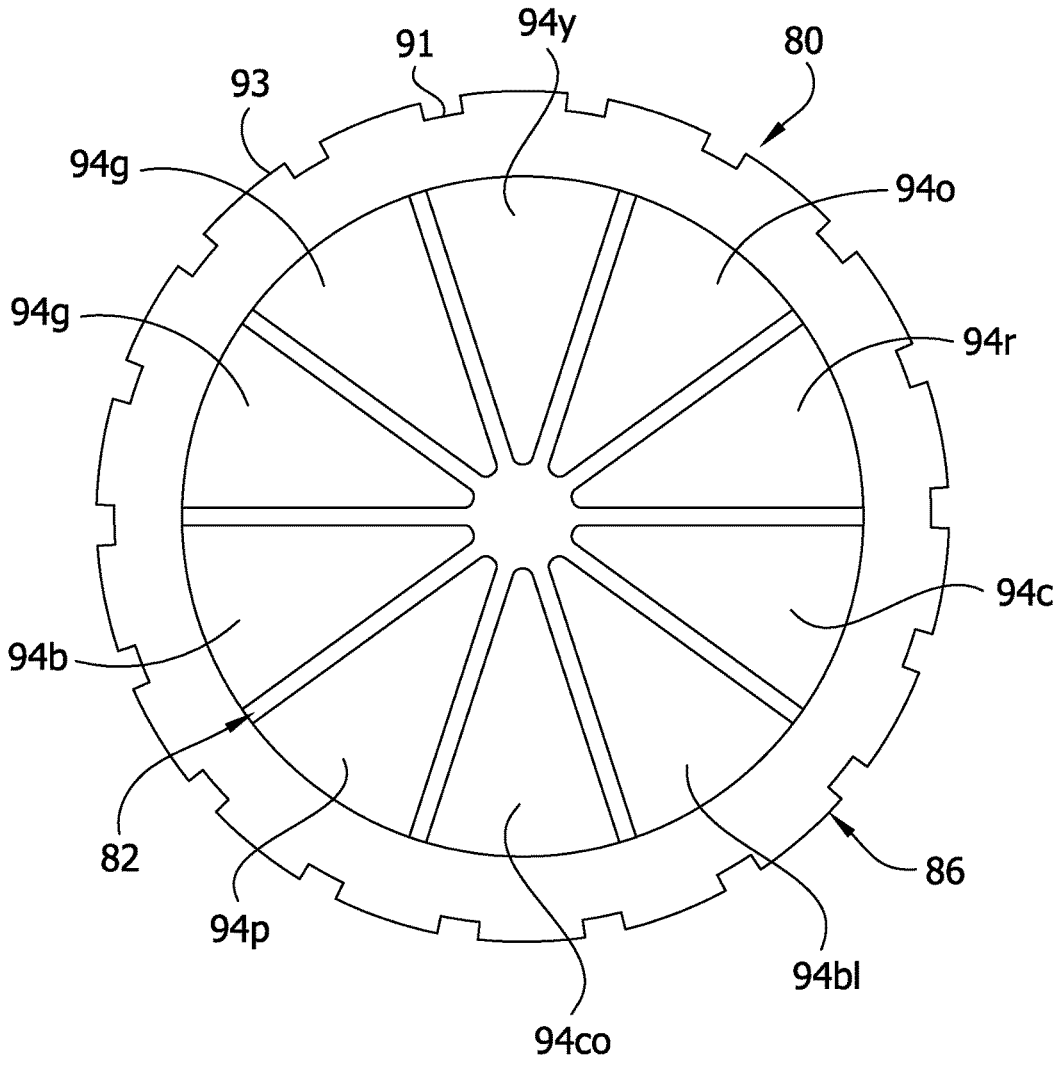
FIG. 14 is a top plan view of the color wheel.
Figure 15:
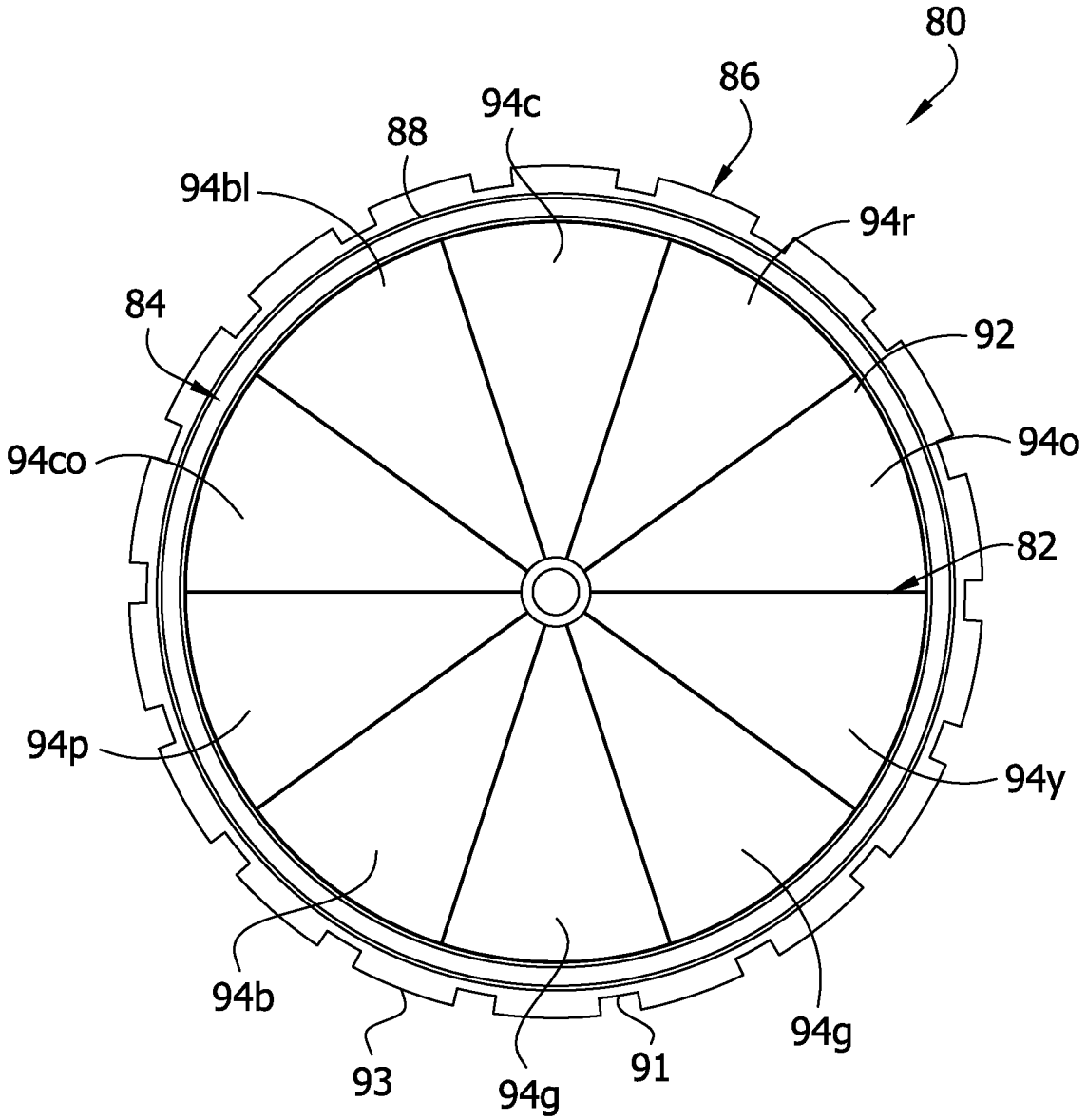
FIG. 15 is a bottom plan view of the color wheel.

Referring to FIGS. 1-6, an LED night-light assembly of the present disclosure is generally indicated at 10. The assembly includes a housing 12 having a front panel 14 and a back panel 16 connected to the front panel by a screw 18 (FIG. 6). An optional transparent cover 19 is secured to the housing 12. First and second parallel prongs 20 are supported by the housing 12 and are received through slots 24 in the back panel 16. A printed circuit board (PCB) 26 is electrically connected to the prongs 20 (FIG. 6). A light-emitting diode (LED) 28 has lead wires 30 electrically connecting the LED to the PCB 26 (FIG. 9). In one embodiment, the LED 28 emits a white light when energized. A plate 36 seats the LED 28 in the housing 12. A button 38 is mounted on the front panel 14. The button 38 is moveable to engage a switch 40 on the PCB 26 for powering the assembly on and off when the prongs engage an electrical outlet connected to a power source. The button 38 and switch 40 may be broadly considered a switch assembly.

Figure 1:
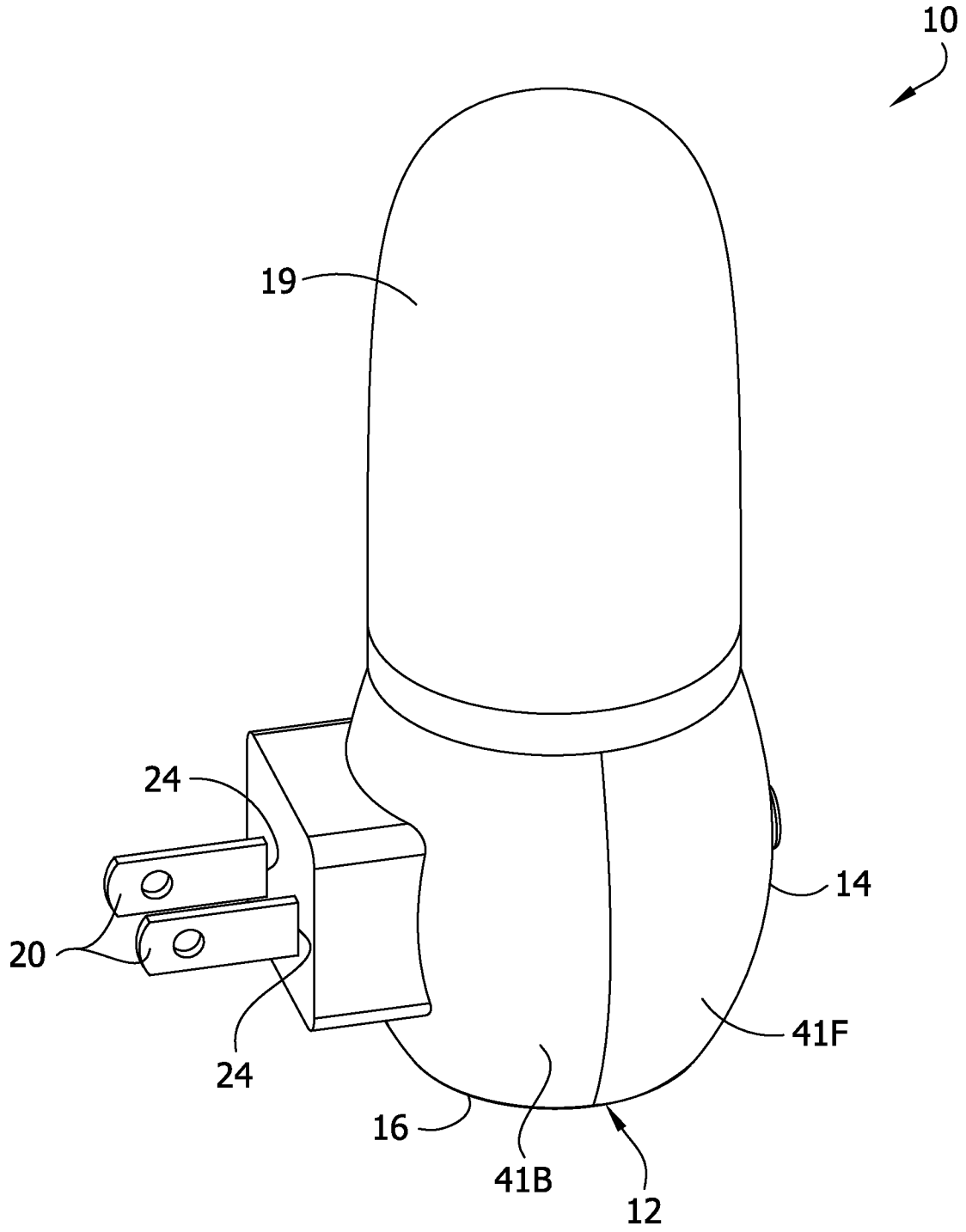
FIG. 1 is a rear perspective view of an LED night-light.
Figure 2:
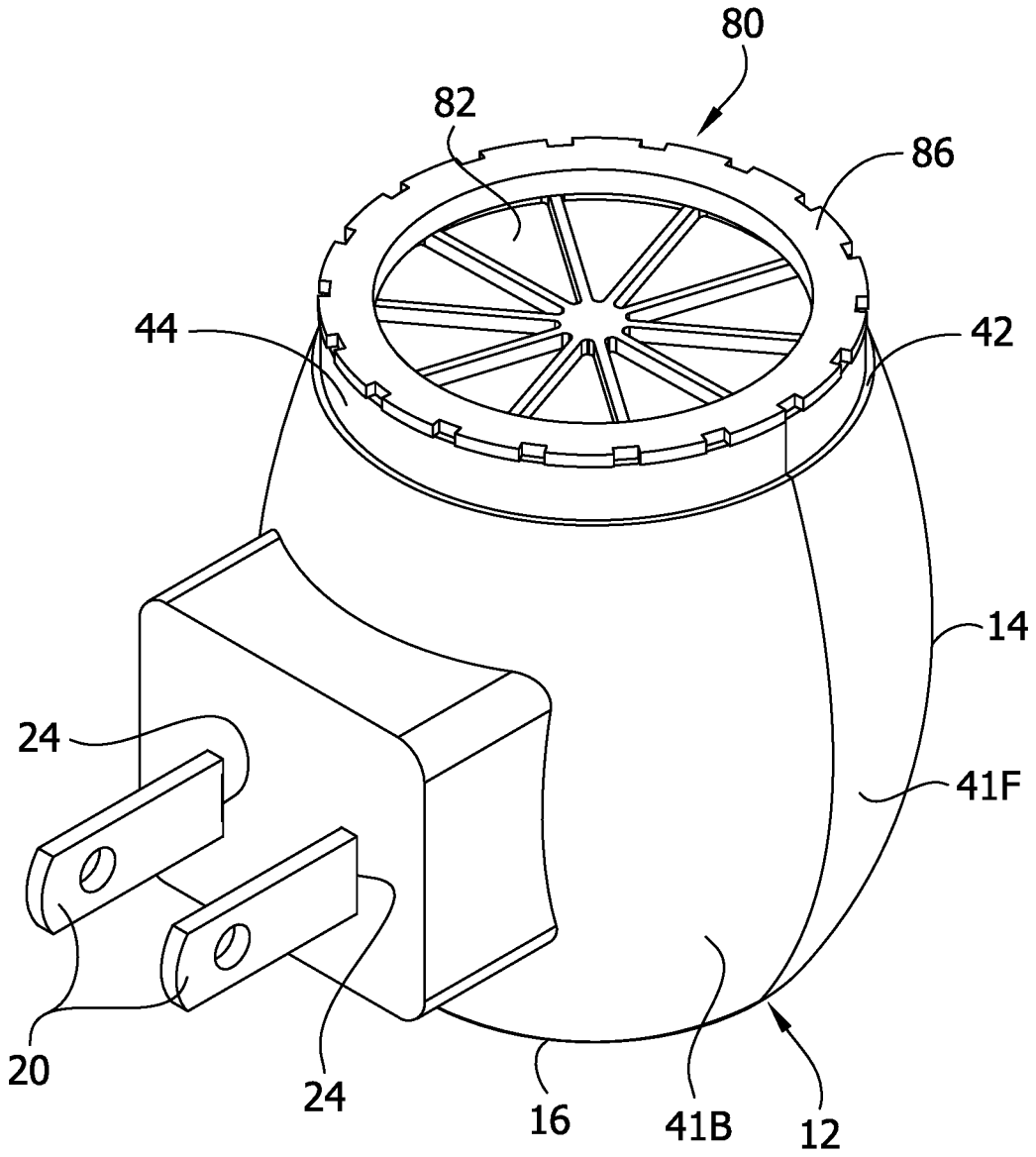
FIG. 2 is a rear perspective view of the LED night-light with a cover removed.
Figure 3:
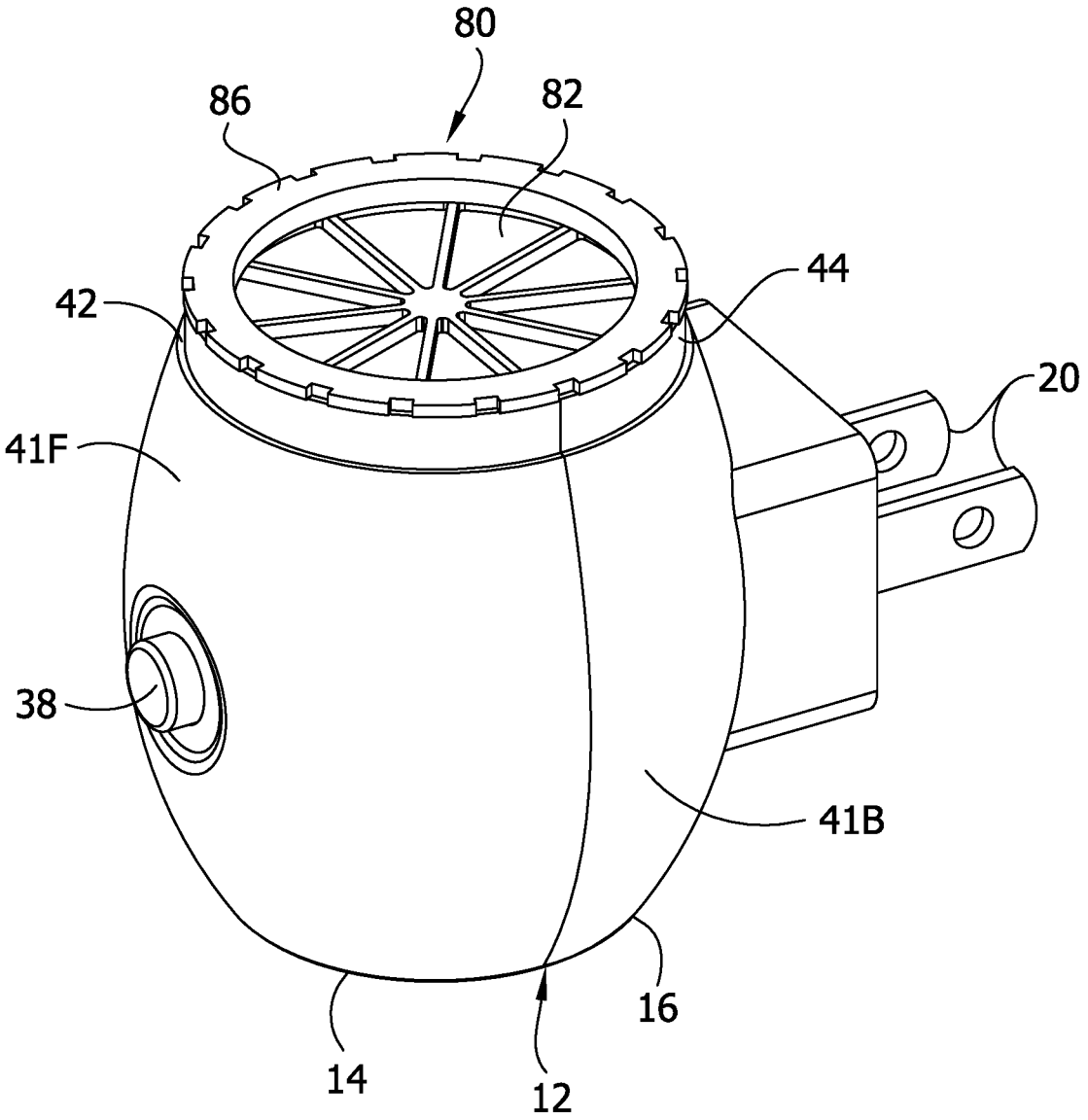
FIG. 3 is a front perspective view of the LED night-light with the cover removed.
Figure 4:
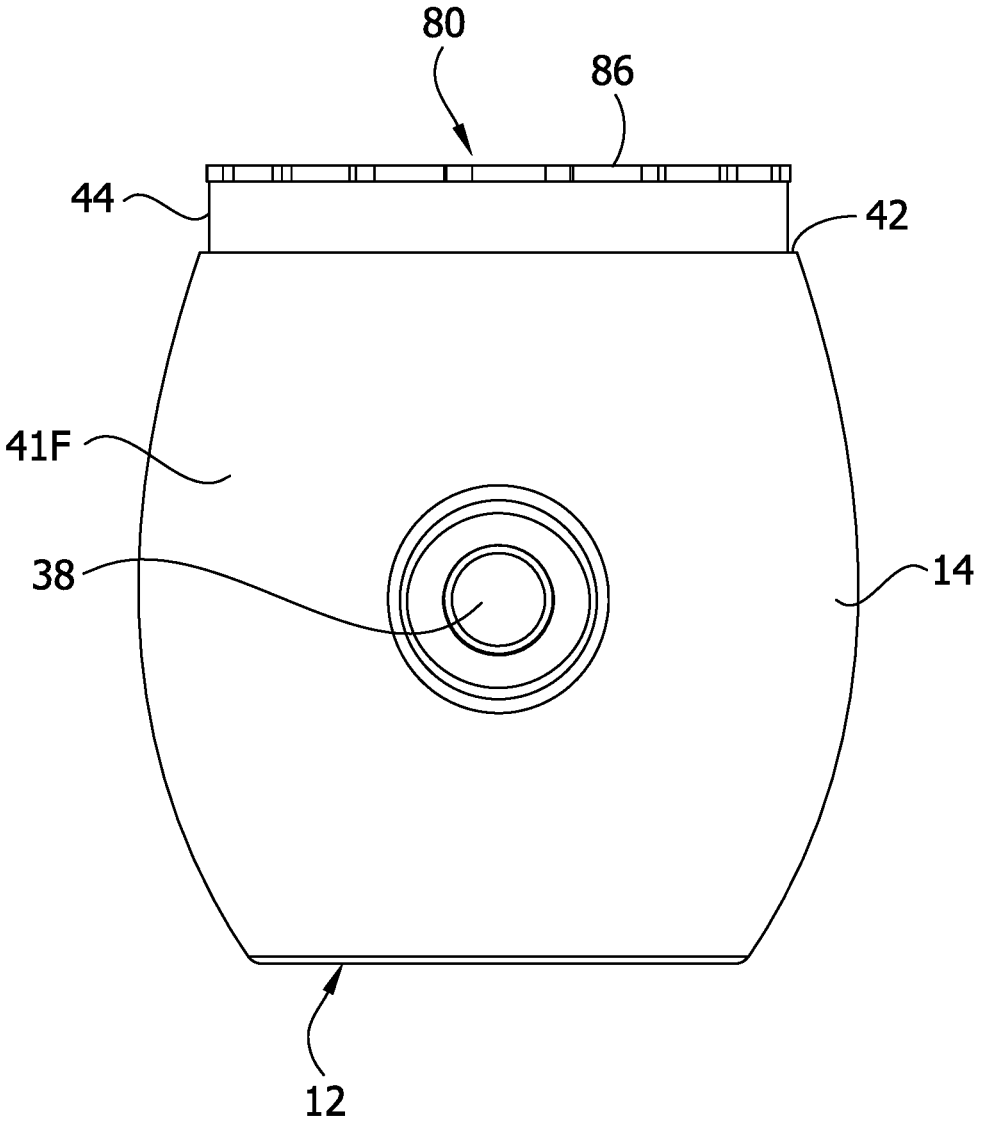
FIG. 4 is a front view of the LED night-light of FIG. 3.
Figure 5:
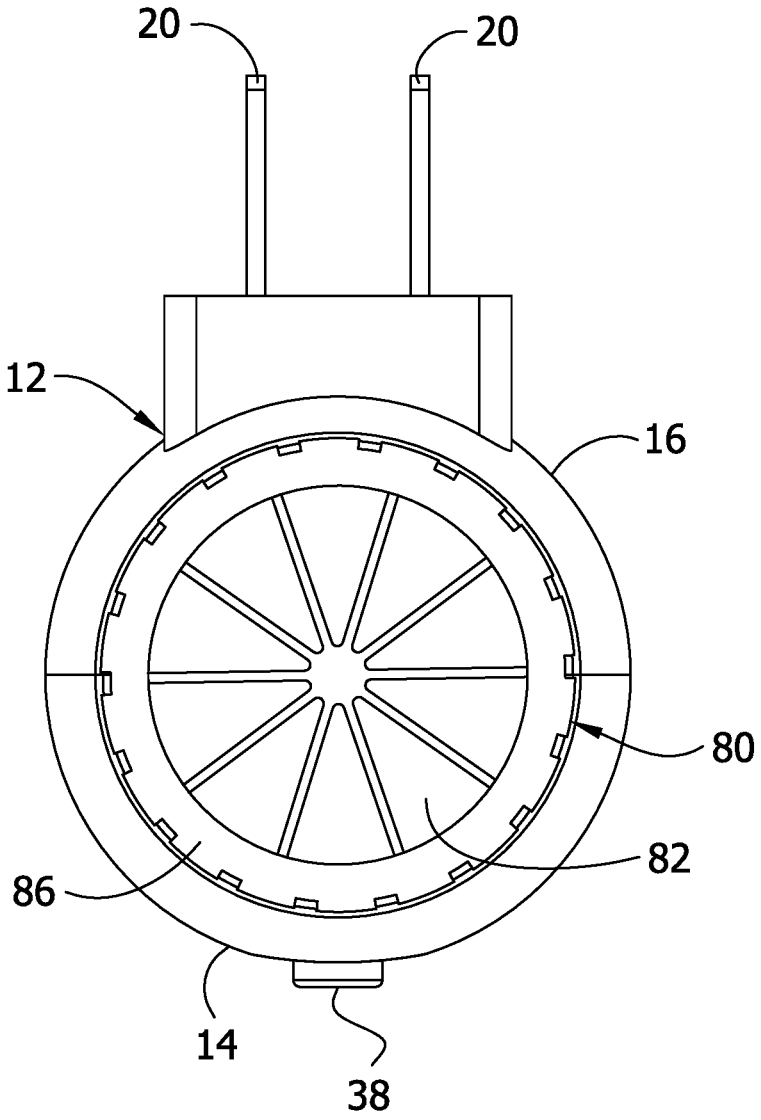
FIG. 5 is a top plan view of the LED night-light of FIG. 3.

Each panel 14, 16 of the housing 12 has a semi-cylindrical portion 41F, 41B. An annular shoulder 42 extends around the housing 12 near a top of the semi-cylindrical portions 41F, 41B. An annular neck 44 extends upward from the annular shoulder 42. The optional cover 19 has a hollow cylindrical shape with an inner diameter at a bottom of the cover that is slightly larger than an outer diameter of the annular neck 44 such that the cover slides over the neck and seats on the shoulder 42 for attaching the cover to the housing 12 (FIG. 1). It will be understood that the cover 19 can be attached to the housing 12 in any suitable manner and other covers or no cover may be used, within the scope of the present disclosure.

Referring to FIGS. 6-13, the semi-cylindrical portions 41F, 41B form a cylindrical housing for containing the internal components of the night-light 10. An opening 45 (FIG. 9) in the top of the housing 12 forms a rim 47 surrounding the opening. The housing 12 houses, at least partially, the PCB 26, prongs 20, button 38, and switch 40 within an interior of the housing. A bore 54F, 54B in the front and back panels 14, 16 receives the screw 18 by a threaded engagement for connecting the panels 14, 16. The front and back panels 14, 16 have mating side edges 55 which engage each other when the panels are connected by the screw 18. The back panel 16 slideably receives interior ends of the prongs 20, 22. When received in the back panel 16, the prongs are supported in parallel by the housing 12. The prongs are prevented from sliding out the back of the back panel 16 once the prongs are inserted in the back panel 16. Exterior ends of the prongs 20 extend out of the housing 12 and are configured for insertion into an electrical outlet (not shown) connected to a power source. The front panel 14 also has a hole 64 (FIGS. 11 and 12) and a positioning sleeve 66 which receive and position the button 38 in the front panel 14. A key 68 in the positioning sleeve 66 receives a tab 70 on the button 38 to prevent the button from rotating in the sleeve. It is understood that the housing can have other configurations and still be within the scope of the present disclosure. For instance the housing could have other shapes or be formed from a single piece.

Referring to FIGS. 6-10, the PCB 26 comprises a rigid substrate having an electrically conductive surface layer L. The PCB 26 along with the conductive surface layer is electrically connected to the prongs 20 by wires (not shown) which electrically interconnect the prongs 20 and the layer L. Electrically connected to the PCB 26 is circuitry 72 (FIG. 9) configured for energizing the LED 28 when the prongs 20 engage an outlet connected to a power source. The circuitry 72 comprises standard electrical components well known to those of skill in the art and therefore will not be described in any further detail. The plate 36 supports the LED 28 above the PCB 26 and below the rim 47 of the housing 12 for positioning the LED 28 in the interior of the housing. Accordingly, an entirety of the LED 28 is disposed below the rim 47 and within the interior of the housing 12.

Referring to FIGS. 2-8, 14, and 15, a color wheel 80 is supported at the top of the housing 12. The color wheel 80 is rotatable relative to the housing 12 to selectively place color sections of a color filter 82 in registration with the LED 28 to selectively produce light of different colors by filtering the light being emitted from the LED. The color wheel 80 comprises an annular disk 84, the color filter 82 attached to a bottom surface of the disk, and a dial 86 mounted to a top surface of the disk. The disk 84 has a lip 88 (FIG. 15) extending circumferentially around the disk. The lip 88 on the disk 84 is received in a groove 90 in an interior surface of the housing 12 for securing the disk and thus the color wheel 80 to the housing. The dial 86 rests on the rim 47 of the housing 12 and is configured to be grasped by a user to rotate the disk 84 and filter 82 relative to the housing. The dial 86 includes notches 91 in a circumferentially extending surface that form projections 93 which provide a grip surface on the dial which helps the user better grasp the dial for rotating the color wheel 80.

In the illustrated embodiment, the color filter 82 comprises a film 92 including a plurality of pie-shaped color sections 94. In one embodiment, the color sections include a clear section 94*c*, a red section 94*r*, an orange section 94*o*, a yellow section 94*y*, a pair of green sections 94*g*, a blue section 94*b*, a pink section 94*p*, a coral section 94*co*, and a black section 94 *bl*. Grasping the dial 86 and rotating the disk 84 and film 92 relative to the LED 28 allows a user to selectively locate a color section 94 in registration with the LED so that the selected color section filters the light emitted from the LED in the desired manner. Thus, the desired colored light will ultimately be perceived by the environment using a single white light LED 28. This eliminates the need for replacing the actual LED 28 with a different colored LED when a different light color is desired.

In the illustrated embodiment, the color filter 82 is a film 92 having multiple color sections 94. However, the color filter 82 could have other configurations and still be within the scope of the present disclosure. For instance, the color filter 82 could comprise separate pieces of film each having a different color. Alternatively, the color filter 82 could comprise a structure other than a film of material.

Referring to FIGS. 3, 4, 6, and 10-13, the button 38 is movable in the sleeve 66 to engage the switch 40 for powering on and off the assembly 10. In operation, the button 38 can be depressed to engage the switch 40 such that if the assembly 10 is connected to a power source, the circuitry 72 and LED 28 will be energized, powering on the LED. The button 38 can be depressed again to engage the switch 40 to de-energize the circuitry 72 and LED 28, powering off the LED. It should be understood, however, that other configurations and types of buttons and switches can be utilized within the scope of the present disclosure. For example, a toggle switch can be used to power on and off the assembly.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An LED night-light comprising:

a housing;

first and second prongs extending out of the housing;

a light-emitting diode mounted to the housing and configured to emit a first color of light;

circuitry electrically connected to the light-emitting diode, said circuitry configured for energizing the light-emitting diode when the first and second prongs are inserted into an electrical outlet connected to a power source;

a color wheel mounted on the housing and exposed from the housing such that the color wheel is configured to be grasped by a user to manually move the color wheel relative to the housing, the color wheel comprising a color filter being configured to filter the first color of light emitted from the light emitting diode to produce at least a second color of light different from the first color of light; and a cover mounted on the housing, the cover having a closed top.

2. The LED night-light set forth in claim 1, wherein the color filter is configured to filter the first color of light emitted from the light emitting diode to produce a plurality of colors of light different from the first color of light.

3. The LED night-light set forth in claim 2, wherein the color filter comprises a plurality of color filter sections that are movable in registration with the light-emitting diode to filter the first color of light emitted from the light emitting diode.

4. The LED night-light set forth in claim 3, wherein the plurality of color filter sections comprise a clear section, a red section, an orange section, a yellow section, a green section, a blue section, a pink section, a coral section, and a black section.

5. The LED night-light set forth in claim 3, wherein the color filter is rotatably mounted on the housing to selectively place the color filter sections in registration with the light-emitting diode.

6. The LED night-light set forth in claim 5, wherein the color filter comprising a film, the plurality of color filter sections being defined by colored sections of the film.

7. The LED night-light set forth in claim 6, wherein the film comprises a circular piece of material, the plurality of color filter sections each comprising pie shaped portions of the circular piece of material.

8. The LED night-light set forth in claim 5, further comprising a disk received within a groove in the housing, the color filter being mounted on the disk so that movement of the disk in the groove causes the color filter to rotate relative to the housing.

9. The LED night-light set forth in claim 8, further comprising a dial mounted on the disk, the dial being configured to be grasped by a user to rotate the disk in the groove for rotating the color filter relative to the housing.

10. The LED night-light set forth in claim 9, wherein the housing includes a rim, the dial being seated on the rim.

11. The LED night-light set forth in claim 10, wherein the light-emitting diode is disposed entirely within the housing below the rim of the housing.

12. The LED night-light set forth in claim 1, further comprising a plate mounting the light-emitting diode.

13. The LED night-light set forth in claim 1, further comprising a switch assembly mounted to the housing and actuatable to selectively energize and de-energize the light-emitting diode when the first and second prongs are inserted into an electrical outlet connected to a power source.

* * * * *